US009376872B2

(12) United States Patent
June

(10) Patent No.: US 9,376,872 B2
(45) Date of Patent: Jun. 28, 2016

(54) TUBING HANGER ORIENTATION SPOOL

(71) Applicant: OneSubsea IP UK Limited, London (GB)

(72) Inventor: David R. June, Houston, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 14/207,308

(22) Filed: Mar. 12, 2014

(65) Prior Publication Data

US 2015/0259990 A1 Sep. 17, 2015

(51) Int. Cl.

| | |
|---|---|
| ***E21B 23/04*** | (2006.01) |
| ***E21B 43/01*** | (2006.01) |
| ***E21B 23/00*** | (2006.01) |
| ***E21B 19/00*** | (2006.01) |
| ***E21B 19/06*** | (2006.01) |
| ***E21B 19/24*** | (2006.01) |
| ***E21B 33/038*** | (2006.01) |
| ***E21B 33/04*** | (2006.01) |
| ***E21B 43/10*** | (2006.01) |

(52) U.S. Cl.

CPC ..... *E21B 19/002* (2013.01); *E21B 19/06* (2013.01); *E21B 19/24* (2013.01); *E21B 23/006* (2013.01); *E21B 33/038* (2013.01); *E21B 33/04* (2013.01); *E21B 43/101* (2013.01)

(58) Field of Classification Search

None

See application file for complete search history.

(56) References Cited

U.S. PATENT DOCUMENTS

| | | | | |
|---|---|---|---|---|
| 4,386,656 | A * | 6/1983 | Fisher | E21B 33/047 166/117.5 |
| 5,145,006 | A | 9/1992 | June | |
| 5,372,199 | A | 12/1994 | Cegielski et al. | |
| 7,032,673 | B2 | 4/2006 | Dezen et al. | |
| 2011/0253389 | A1 * | 10/2011 | Nguyen | E21B 33/04 166/382 |

* cited by examiner

*Primary Examiner* — Matthew R Buck
*Assistant Examiner* — Douglas S Wood
(74) *Attorney, Agent, or Firm* — Chamberlain Hrdlicka

(57) ABSTRACT

A subsea well installation assembly for installing a tubing hanger in a subsea well includes a spool with a spool orientation feature and a running tool connectable to the tubing hanger with a running tool orientation feature. The tubing hanger is rotatable to the predetermined orientation by movement of the running tool with respect to the spool such that the running tool orientation feature engages the spool orientation feature, and the tubing hanger is landable in the predetermined orientation by movement of the running tool with respect to the spool such that the running tool orientation feature engages the spool orientation feature.

20 Claims, 5 Drawing Sheets

TUBING HANGER ORIENTATION SPOOL

BACKGROUND

Subsea field development and completion wells are often drilled in a pattern that spaces the wells apart from each other. Some wells have production trees that connect to flowlines at the sea floor. The flowlines typically lead to manifolds, templates, or other subsea processing units that collect or redistribute the product coming from the well. The flowline connector for each tree is often configured horizontally and off to one side of the tree.

When developing the field, the operator orients the tree connector to align with a flowline hub or receptacle. That hub or receptacle may reside in a multi-well template that includes manifold components, in which the template will therefore receive a Christmas or production tree.

A typical subsea wellhead structure has a high pressure wellhead housing secured to a low pressure housing, such as conductor casing. The wellhead structure supports casing that extends into the well. One or more casing hangers land in a component of the wellhead structure, such as the high pressure wellhead housing, with each casing hanger being located at the upper end of a string of casing that extends into the well. A string of tubing extends through the casing for conveying production fluids, in which the tubing string is supported using a tubing hanger. The area between the tubing and casing is referred to as the annulus. Vertical completion arrangements typically plan for the tubing hanger to be landed in and supported by the wellhead structure. In this type of completion arrangement, the Christmas or production tree may attach to the wellhead structure, such as the high pressure housing, tubing spool, tubing head, or wellhead adapter, for controlling the well fluid. The tubing hanger landed in the wellhead structure will have one or more passages that may include a production passage, an annulus passage, and various hydraulic and electric control lines. While allowing access to the annulus passage, having more than one passage might lead to accurate tree to tubing hanger orientation. The tree has isolation tubes that stab vertically into engagement with the passages in the tubing hanger when the tree lands on the wellhead structure. These vertical connections may lead to precise alignment of the tree with the tubing hanger both in the vertical and the radial orientation.

Because the tree may be aligned to the tubing hanger and the flowline connection, the tubing hanger may then be aligned to the flowline connection when landed. In this type of completion arrangement, orientation is typically achieved by using the blowout preventer (BOP) assembly for guidance. The BOP assembly has an orientation pin within it that can be extended into the bore. The tubing hanger has an orientation member located in the running string that engages the internal orientation pin of the BOP assembly, and therefore aligns the tubing hanger. The BOP assembly and the tree assembly then each have an external alignment receptacle that fits over a post or feature outside the wellhead structure that is oriented to the flowline heading.

Accordingly, over the last thirty years, the search for oil and gas offshore has progressively moved into a wider range of accessible environments. As such, it remains a priority to increase the reliability of such systems to be free of installation issues.

BRIEF DESCRIPTION OF THE DRAWINGS

For a detailed description of embodiments of the subject disclosure, reference will now be made to the accompanying drawings in which.

DETAILED DESCRIPTION

Figure 1:
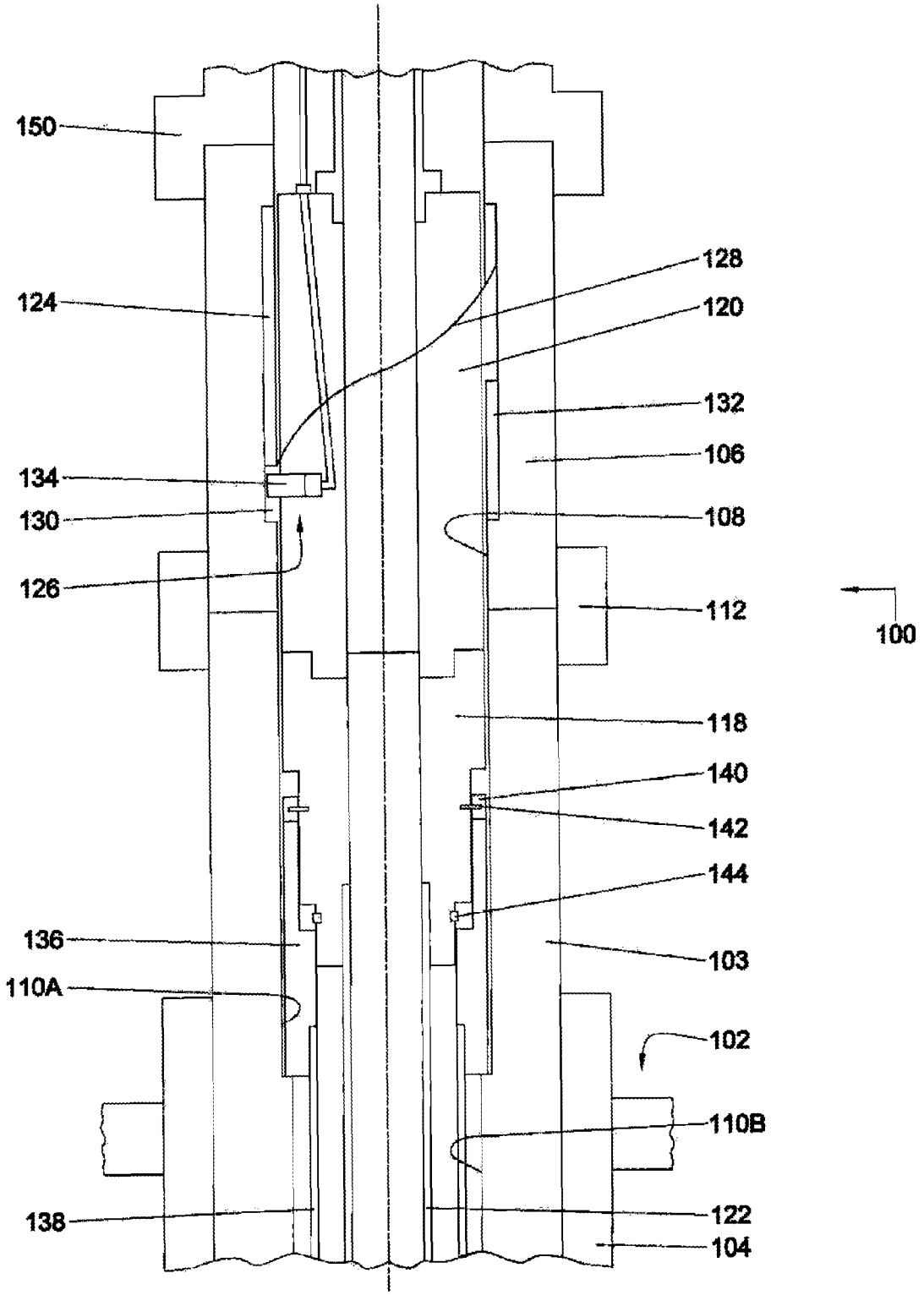
FIG. 1 show a cross-sectional view of a subsea well assembly for use with a wellhead structure of a subsea well in accordance with one or more embodiments of the present disclosure.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. The embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be an illustration of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Accordingly, disclosed herein are an assembly, system, and method for use with a wellhead structure of a subsea well. The wellhead structure may include a high pressure wellhead housing, such as positioned at an upper end of the subsea well, and/or may include any structure in use similar to a high pressure wellhead housing and/or connected or coupled to a high pressure wellhead housing such as a casing spool or a tubing spool. The assembly includes or may be used with a tubing hanger that is landable in a predetermined orientation with respect to the wellhead structure to support production tubing extending into the subsea well. The assembly further includes a spool, such as a tubing hanger orientation spool, with a spool orientation feature. A running tool is connectable to the tubing hanger that includes a running tool orientation feature. As such, the tubing hanger is orientable to the predetermined orientation by upward movement of the running tool with respect to the spool such that the running tool orientation feature engages the spool orientation feature. Further, once oriented the tubing hanger is landable in the predetermined orientation by downward movement of the running tool with respect to the spool guided by the interaction of the running tool orientation feature and the spool orientation feature.

Furthermore, in one embodiment, the spool orientation feature, or the running tool orientation feature, may include a camming surface, such as a down-facing or upward-facing camming surface in one or more embodiments, with a guiding feature, such as an orientation slot. The running tool orientation feature, or the spool orientation feature, may then include a camming member, such as a pin configured to be selectively extendable for engagement with the camming surface. In such an embodiment, the tubing hanger may be orientable or rotatable to the predetermined orientation by upward movement of the pin against the camming surface, or the camming surface against the pin, and the tubing hanger is landable in the predetermined orientation by downward movement of the running tool with the pin in the orientation slot.

Referring now to FIG. 1, a cross-sectional view of a subsea well assembly 100 for use with a wellhead structure 102 of a subsea well 104 in accordance with one or more embodiments of the present disclosure is shown. The assembly 100 includes a spool 106, such as an orientation spool, that may be connected to a high pressure wellhead housing 103. In particular, the spool 106 may include a bore 108 formed therethrough, and the wellhead structure 102 may include bores 110A and 110B formed therethrough. The bore 108 of the spool 106 may be aligned with the bores 110A and 110B of the wellhead structure 102 when the spool 106 is connected to the wellhead structure 102. It should be appreciated that the orientation spool 106 may be connected to other components of the wellhead structure 102 than the high pressure wellhead housing 103.

In one or more embodiments, a connector 112 may be used to facilitate connecting the spool 106 to the wellhead structure 102. For example, the connector 112 may be connected to the spool 106, such as at the surface, and then the spool 106 and the connector 112 may be lowered on and/or connected to the wellhead structure 102 when at the well 104. To facilitate connecting the spool 106 to the wellhead structure 102, one or more orientation features may be used or included between the spool 106, the connector 112, the wellhead structure 102, and/or the well 104. In one embodiment, the spool 106 and/or the connector 112 may include an orientation feature and/or have the orientation feature keyed thereto, and the wellhead structure 102 and/or the well 104 may include a corresponding orientation feature and/or have the corresponding orientation feature keyed thereto.

Figure 2:
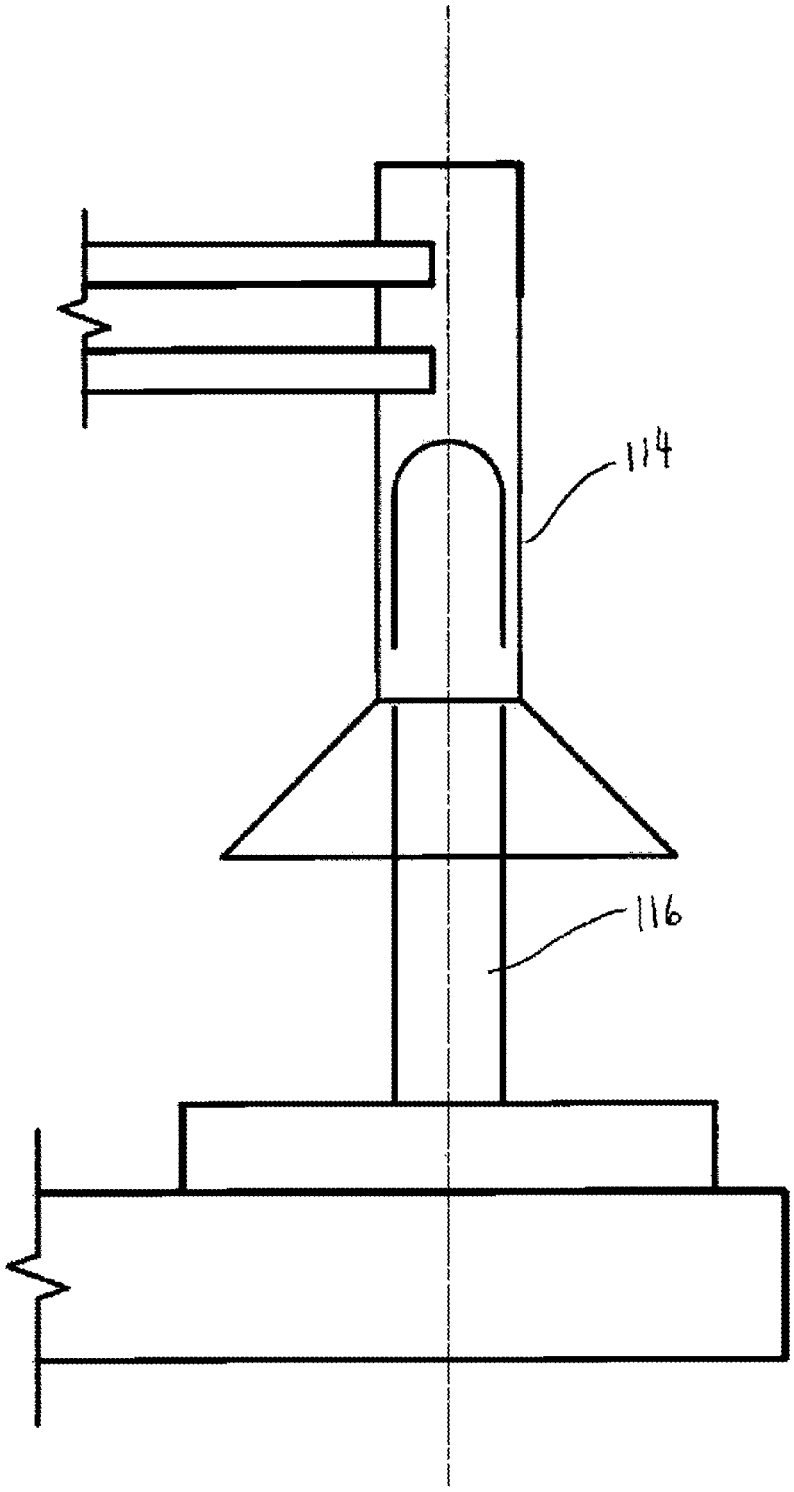
FIG. 2 shows a schematic view of a female receptacle orientation feature engaged with a male member corresponding orientation feature in accordance with one or more embodiments of the present disclosure.

For example, with reference to FIG. 2, the spool 106 and/or the connector 112 may include an orientation feature, such as a female receptacle 114, and the wellhead structure 102 and/or the well 104 may include a corresponding orientation feature, such as a male member 116. The orientation feature of the spool 106 and/or the connector 112 may engage the corresponding orientation feature of the wellhead structure 102 and/or the well 104, such as when lowering the spool 106 with respect to the wellhead structure 102, to orient the spool 106 to a predetermined orientation with respect the wellhead structure 102.

Referring again to FIG. 1, the assembly 100 may further include or be used in conjunction with a tubing hanger 118 and a running tool 120 connectable to the tubing hanger 118. The running tool 120 may be run, such as from the surface, to orient and land the tubing hanger 118 in a predetermined radial orientation with respect to the wellhead structure 102 to support production tubing 122 that extends into the well 104. Once landed in the desired orientation and/or position, the running tool 120 may detach and/or be disconnected from the tubing hanger 118 to leave the tubing hanger 118 in place.

To facilitate landing or orienting the tubing hanger 118 in a desired or predetermined orientation or position with respect to the wellhead structure 102, one or more orientation features may be used or included between the spool 106 and/or the running tool 120. The spool 106 may include a spool orientation feature 124, and the running tool 120 may include a running tool orientation feature 126. The spool orientation feature 124 and the running tool orientation feature 126 may then engage with each other to radially orient the running tool 120 and thus the tubing hanger 118 with respect to the spool 106 and/or the wellhead structure 102.

For example, with reference to FIG. 1, the spool orientation feature 124 may include a camming surface 128, which, in one or more embodiments, may include a helical groove. The camming surface 128 may be included and/or formed in the bore of the spool 106, in which the camming surface 128 may be down-facing in this embodiment such that a face of the camming surface 128 faces downward towards the tubing hanger 118 and/or the wellhead structure 102. The spool orientation feature 124 may further include a clearance 130, such as adjacent one end of the camming surface 128, and a guiding feature, such as adjacent another end of the camming surface 128. In this embodiment, the guiding feature is shown as an orientation slot 132, though the present disclosure is not so limited, as any guiding feature known in the art may be used without departing from the scope of the present disclosure.

Figure 3:
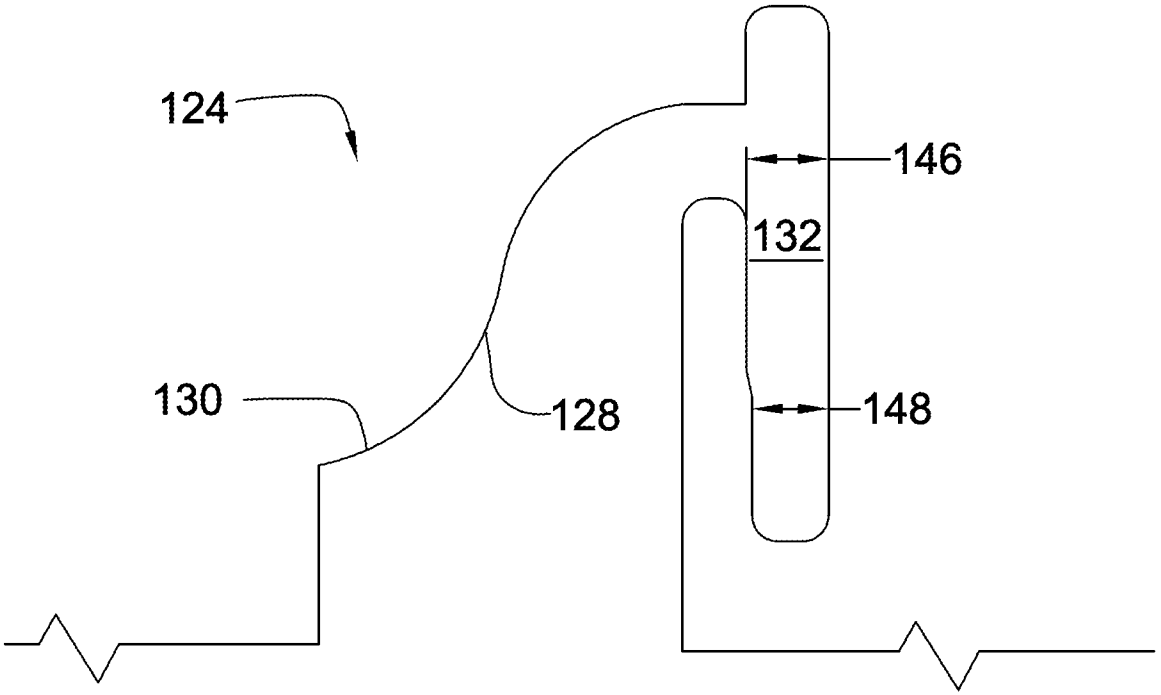
FIG. 3 shows two-dimensional detailed view of a spool orientation feature with a camming surface, a clearance, and an orientation slot in accordance with one or more embodiments of the present disclosure.

The running tool orientation feature 126 may include a camming member that may selectively engage with the camming surface 128. For example, a camming member may include a pin 134, an end, or an appropriately defined feature or surface without departing from the scope of the present disclosure. As shown, the running tool orientation feature 126 may include a pin 134 that is selectively extendable for engagement with the camming surface 128. Though the present disclosure is not limited to only this configuration or arrangement, FIG. 3 shows two-dimensional detailed view of the spool orientation feature 124 with the camming surface 128, the clearance 130, and the slot 132.

Those having ordinary skill in the art will appreciate that, though the spool 106 is shown and discussed as including the camming surface 128, the clearance 130, and the slot 132 and the running tool 120 is shown and discussed as including the pin 134, the present disclosure is not so limited. For example, other orientation features may be used with the spool 106 and/or the running tool 120, and/or the orientation features may be swapped in location with the spool 106 including the pin 134 and the running tool 120 including the camming surface 128, the clearance 130, and the slot 132. Further discussion of this embodiment is included below. Other embodiments and arrangements are envisioned in addition to those shown, without departing from the scope of the present disclosure. The above and below discussions may also be applied to such other embodiments and arrangements.

Referring still to FIG. 1, the tubing hanger 118 may be landable in or on a seat 136, in which the seat 136 may be included in one or both of the bores 110A and 110B of the wellhead structure 102, such as having the seat 136 landed on a shoulder between the bores 110A and 110B. As shown, the seat 136 may include or be a casing hanger, in which the casing hanger may support casing 138 extending into the well 104. The tubing hanger 118 may include a landing ring 140, such as connected to an outer surface thereof, in which one or more shear pins 142 may be used to connect the landing ring 140 to the tubing hanger 118. Further, the tubing hanger 118 may include one or more anti-rotation splines 144, in which the anti-rotation splines 144 may engage the seat 136 to prevent rotation between the tubing hanger 118 and the seat 136 when the tubing hanger 118 is landed on or in the seat 136.

When orienting and landing the tubing hanger 118 in a predetermined orientation with respect to one or more components of the assembly 100, the running tool 120 with the tubing hanger 118 connected thereto may be lowered into the spool 106. Once past the camming surface 128, such as when positioned adjacent to or within the clearance 130, the pin 134 may be extended from and with respect to the running tool 120 and into the clearance 130. The pin may be extended by any suitable means, such a hydraulically, mechanically, electrically, or any combination of these, and may further be manually controlled and/or automated for control. Further, the landing ring 140 may remain coupled to the tubing hanger 118 through the shear pins 142, in which the landing ring 140 may engage and/or land on the seat 136. For example, the position of the tubing hanger 118 and/or the running tool 120 with respect to the wellhead structure 102, the spool 106, and/or the seat 136 in FIG. 1 with the shearing pins intact may be referred to as a soft landed position. In the soft landed position, the landing ring 140 may be coupled to the tubing hanger 118 through the shear pins 142, the landing ring 140 may engage and/or land on the seat 136, and the pin 134 may be positioned and extend in the clearance 134.

One or more compensators on a surface platform or structure (not shown but understood by those skilled in the art) may be used to facilitate landing in the soft landed position when lowering the running tool 120 and tubing hanger 118, such as to facilitate preventing the shear pins 142 from shearing. For example, in one embodiment, the shear pins 142 may be manufactured to shear upon receiving a certain amount of shear force, such as about 100,000 lbs of shear force. The compensator may be set to an amount lower than this shearing force, such as set to about 20,000 lbs in one embodiment, in which the compensator may prevent movement of the running tool 120 and tubing hanger 118 when the compensator determines that the set amount of force has been applied to the landing ring 140. This may facilitate landing the tubing hanger 118 in the soft landed position and prevent shearing the shear pins 142 prematurely.

After landing in the soft landed position, the running tool 120 with the tubing hanger 118 connected thereto may be raised with respect to the spool 106 with the pin 134 extended. This movement may enable the pin 134 to engage and slide against the camming surface 128, thereby orienting and rotating the running tool 120 and the tubing hanger 118 to a desired and/or predetermined orientation with respect to the spool 106 and/or the wellhead structure 102. Continued raising of the running tool 120 may then have the pin 134 follow the camming surface 128 such that the pin 134 engages and is positioned in the slot 132.

Once the pin 134 is positioned adjacent or in the slot 132, the running tool 120 with the tubing hanger 118 connected thereto may again be lowered to land the tubing hanger 118 in the predetermined orientation with respect to the spool 106 and/or the wellhead structure 102. This movement may enable the pin 134 to be guided by or otherwise engage and slide in the slot 132. The slot 132 may be tapered, such as shown in FIG. 3, in which the slot 132 may include a wider portion 146 towards an upper end of the slot 132 and a narrower portion 148 towards a lower end of the slot 132. By having the slot 132 tapered, or narrowed, even more precision may be used when orienting and landing the tubing hanger 118 in the desired or predetermined orientation.

As the running tool 120 with the tubing hanger 118 is lowered, the tubing hanger 118 may land in the seat 136 in a hard landed position. The hard landed position may be the final position for the tubing hanger 118 before the running tool 120 detaches from the tubing hanger 118. In the hard landed position, the shear pins 142 may shear such that the landing ring 140 is movable, in which the landing ring 140 may move and ride up along the outer surface of the tubing hanger 118 to enable the tubing hanger 118 to engage the seat 136. The pin 134 may remain in the slot 132, in which the pin 134 may be positioned lower within the slot 132 and/or at the end of the slot 132. Further, when moving into the hard landed position, the anti-rotation splines 144 may engage and cut into the seat 136 to prevent rotation of the tubing hanger 118 with respect to the wellhead structure 102. Furthermore, once the pin 134 enters or is engaged with the slot 132, the running tool 120 may be torqued in a direction away from the camming surface 128 to ensure that the pin 134 remains in the slot 132 when, at least initially, lowering the running tool 120 into the hard landed position. This ensures the pin 134 moves downward into the slot 132 instead of reengaging the camming surface 128.

After the tubing hanger 118 is in the hard landed position, the running tool 120 may detach from the tubing hanger 118 and be removed from the spool 106. The orientation spool 106 may then be removed, if desired, such as to connect a blowout preventer assembly, a production tree, and/or other subsea component to the wellhead structure 102. Additionally, or alternatively, the orientation spool 106 may be left in place and a blowout preventer assembly and/or production tree may be connected to the orientation spool 106. For example, with reference to FIG. 1, a blowout preventer 150 may be connected to the spool 106, with the spool 106 and the connector 112 supporting the blowout preventer 150. Alternatively, the spool 106 may be integral or otherwise attached or part of and landed with a blowout preventer 150 that may or may not be part of a blowout preventer stack.

Figure 4:
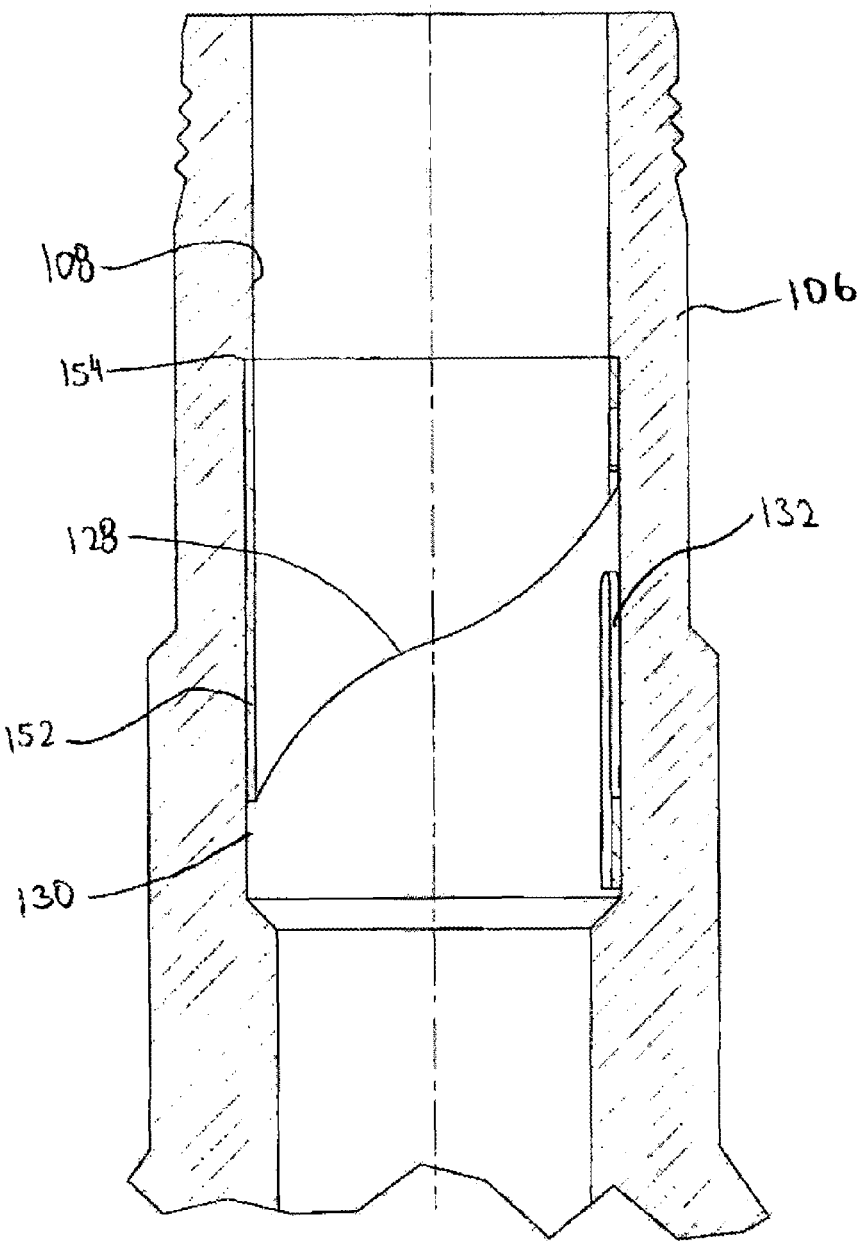
FIG. 4 shows a cross-sectional view of a sleeve including an orientation feature positioned within a recess formed within a bore of a spool in accordance with one or more embodiments of the present disclosure.

In one or more embodiments, such as shown in FIG. 1, the camming surface 128, in addition to the clearance 130 and the slot 132, may be formed in the bore 108 of the spool 106. Additionally or alternatively, the camming surface 128, the clearance 130, and/or the slot 132 may be formed or included within a sleeve. For example, with reference to FIG. 4, the camming surface 128, in addition to the clearance 130 and the slot 132, may be formed in a sleeve 152. The spool 106 may then have a recess 154 formed within the bore 108 of the spool 106, in which the sleeve 152 may be positioned within the recess 154. Although FIG. 4 shows a hub profile at the top of the orientation spool 106, it should be appreciated that any suitable connection may be used, such as a flange connection.

In one or more embodiments, the pin 134 may include a hydraulically actuated pin such that hydraulic pressure may be used to selectively extend the pin 134. It should be appreciated that the pin 134 may also be actuated mechanically, electrically, or by any suitable means. The pin 134 may further be biased towards an un-extended position, such as by including a spring or other biasing mechanism to bias the pin 134 from an extended position, as shown, towards the un-extended position. In such an embodiment, once hydraulic pressure is no longer provided to extend the pin 134, the biasing mechanism may then bias the pin 134 back towards and into the un-extended position, such as when retrieving the running tool 120 from the spool 106.

An assembly, system, and/or method in accordance with one or more embodiments of the present disclosure may be able to have a reduced height of the clearance 130 to compensate for heave. For example, as the running tool and the tubing hanger may be able to land in a soft landed position, with the pin then extended into the clearance and the running tool then raised, the assembly may be able to compensate for heave from a structure or vessel controlling the running tool. If the tubing hanger is not landed in the soft landed position, a larger clearance may otherwise be provided to ensure the pin, when extended, is positioned within the clearance for engagement.

In another embodiment, the spool and the running tool may have increased use with multiple different wells and wellhead structures. For example, when using a blowout preventer or a blowout preventer stack to orient a running tool and a tubing hanger within a well and wellhead, the blowout preventer or stack might be particularly designed such that orientation features engage and align when in use with a well or wellhead structure. In the present disclosure, an assembly may be able to connect with and be in use with multiple wells and wellhead structures, and in fact may be easily removable for use with the other wells and wellhead structures. As such, the present disclosure may prevent the use of a running tool and a uniquely equipped BOP stack, or other similar equipment, to orient components of the completion or production system, such as the production tree and tubing hanger. Therefore, the present disclosure may result in a reduction of operating expenditures and an increase of BOP stack availability.

Figure 5:
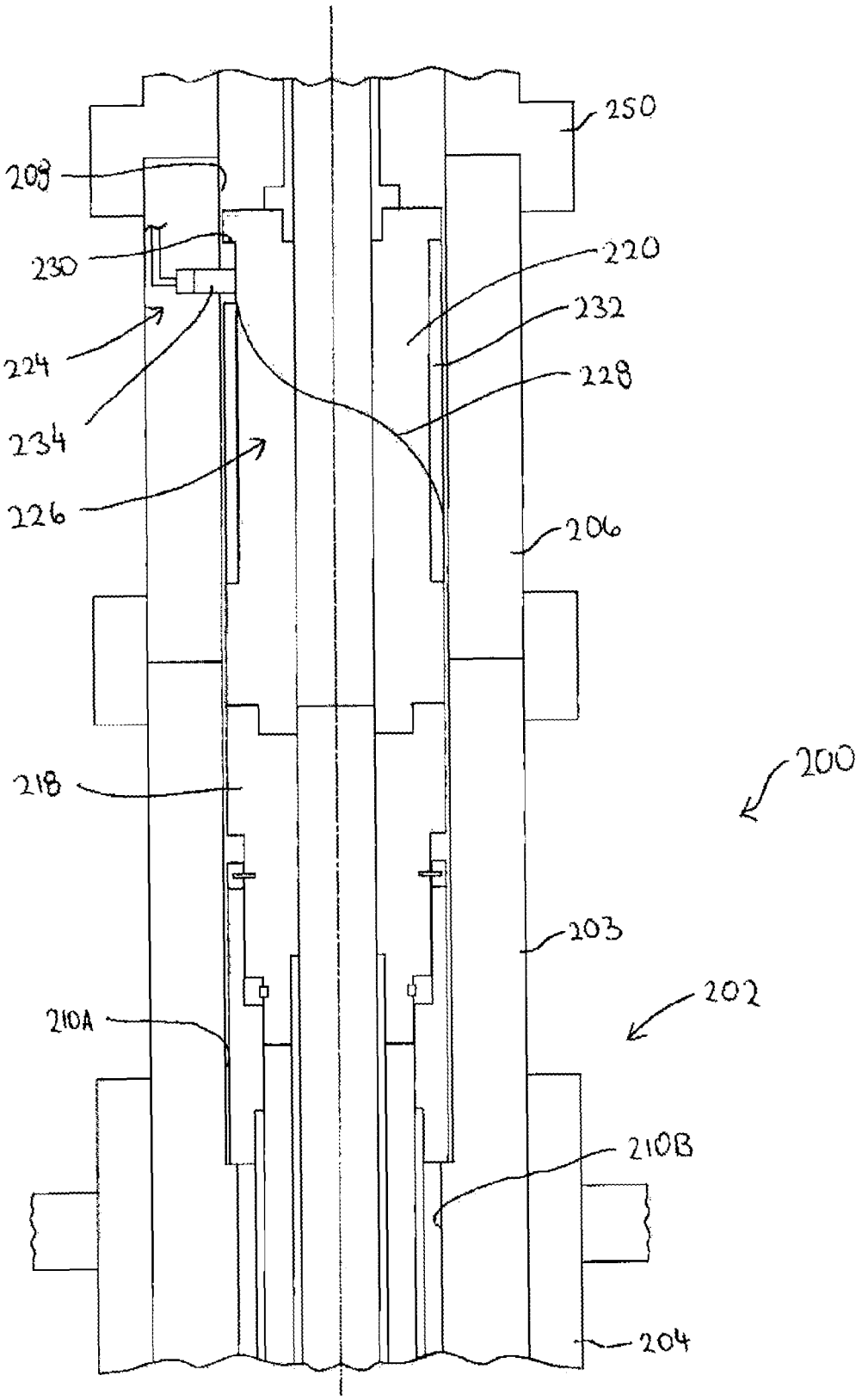
FIG. 5 shows a show a cross-sectional view of another embodiment of a subsea well assembly for use with a wellhead structure of a subsea well in accordance with one or more embodiments of the present disclosure.

In FIG. 5, an alternative embodiment of the subsea well assembly 200 is shown. As mentioned above, this embodiment is similar to the subsea well assembly 100 of FIGS. 1-4 with a difference in the configuration of the orientation features of the tubing hanger running tool and the orientation spool. As shown, instead of the camming surface being on the orientation spool 206, the camming surface 228 is instead on the running tool 220 and is upward-facing. Additionally, the extendable pin 234 is located in the orientation spool 206. However, similar to the embodiment shown in FIGS. 1-4, the tubing hanger running tool 220 is moved upward relative to the orientation spool after being soft landed to orient the tubing hanger 218 with respect to the wellhead structure 202.

Referring now to FIG. 5, a cross-sectional view of a subsea well assembly 200 for use with a wellhead structure 202 of a subsea well 204 in accordance with one or more embodiments of the present disclosure is shown. The assembly 200 includes a spool 206, such as an orientation spool, that may be connected to a high pressure wellhead housing 203. In particular, the spool 206 may include a bore 208 formed therethrough, and the wellhead structure 202 may include one or more bores 210A and 210B formed therethrough. As discussed above, the bore 208 of the spool 206 may be aligned with the bores 210A and 210B of the wellhead structure 202 when the spool 206 is connected to the wellhead structure 202. It should be appreciated that the orientation spool 206 may be connected to other components of the wellhead structure 202 than the high pressure wellhead housing 203.

To facilitate landing or orienting the tubing hanger 218 in a desired or predetermined orientation or position with respect to the wellhead structure 202, one or more orientation features may be used or included between the spool 206 and/or the running tool 220. The spool 206 may include a spool orientation feature 224, and the running tool 220 may include a running tool orientation feature 226. The spool orientation feature 224 and the running tool orientation feature 226 may then engage with each other to radially orient the running tool 220 and thus the tubing hanger 218 with respect to the spool 206 and/or the wellhead structure 202.

For example, with reference to FIG. 5, the running tool orientation feature 226 may include a camming surface 228, which, in one or more embodiments, may include a helical groove. The camming surface 228 may be included and/or formed on the outer surface of the running tool 220, in which the camming surface 228 may be upward-facing such that a face of the camming surface 228 faces upward away from the tubing hanger 218 and/or the wellhead structure 202. The running tool orientation feature 226 may further include a clearance 230, such as adjacent one end of the camming surface 228, and a slot 232, such as adjacent another end of the camming surface 228.

The spool orientation feature 224 may include a pin 234 that is selectively extendable for engagement with the camming surface 228 as described above with respect to the pin 134. However, the present disclosure is not limited to only this configuration or arrangement. Other embodiments and arrangements are envisioned in addition to those shown, without departing from the scope of the present disclosure. The above and below discussions may also be applied to such other embodiments and arrangements.

Referring still to FIG. 5, the tubing hanger 218 may be landed in a soft landed position as described above by lowering the running tool 220 with the tubing hanger 218 into the spool 206. Once the camming surface 228 is past the pin 234, the pin 234 may be extended. The running tool 220 with the tubing hanger 218 connected thereto may then be raised to enable the pin 234 to engage and slide against the camming surface 228, thereby orienting and rotating the running tool 220 and the tubing hanger 218 to a desired and/or predetermined orientation with respect to the spool 206 and/or the wellhead structure 202. Continued raising of the running tool 120 may then have the pin 234 follow the camming surface 228 such that the pin 234 engages and is positioned in the slot 232.

Once the pin 234 is positioned adjacent or in the slot 232, the running tool 220 and the tubing hanger 218 may again be lowered to hard land the tubing hanger 218 in the predetermined orientation with respect to the spool 206 and/or the wellhead structure 202. This movement may enable the pin 234 to be guided by or otherwise engage and slide against the slot 232. The slot 232 may be tapered in which the slot 232 may include a wider portion towards a lower end of the slot 232 and a narrower portion towards an upper end of the slot 232. By having the slot 232 tapered, or narrowed, even more precision may be used when orienting and landing the tubing hanger 218 in the desired or predetermined orientation. Furthermore, once the pin 234 enters or is engaged with the slot 232, the running tool 220 may be torqued in a direction away from the camming surface 228 to ensure that the pin 234 remains in the slot 232 when, at least initially, lowering the running tool 220 into the hard landed position. This ensures the pin 234 moves upward into the slot 232 instead of reengaging the camming surface 228.

After the tubing hanger 218 is in the hard landed position, the running tool 220 may detach from the tubing hanger 218 and be removed from the spool 206. The orientation spool 206 may then be removed, if desired, such as to connect a blowout preventer, a production tree, and/or other subsea component to the wellhead structure 202. Additionally, or alternatively, the orientation spool 206 may be left in place and a blowout preventer and/or production tree may be connected to the orientation spool 206. Alternatively, the spool 206 may be integral or otherwise attached or part of and landed with a blowout preventer 250 that may or may not be part of a blowout preventer stack.

In one or more embodiments, the camming surface 228, in addition to the clearance 230 and the slot 232, may be formed in the outer surface of the tubing hanger running tool 220. Additionally or alternatively, the camming surface 228, the clearance 230, and/or the slot 232 may be formed or included within a sleeve on the outside of the running tool 220.

Although the present invention has been described with respect to specific details, it is not intended that such details should be regarded as limitations on the scope of the invention, except to the extent that they are included in the accompanying claims.

What is claimed is:

1. A subsea well installation assembly for installing a tubing hanger in a subsea well including a wellhead structure, comprising:

a tubing hanger orientation spool separate from and connectable to the wellhead structure, the tubing hanger orientation spool comprising:

a bore comprising a camming surface and a guiding feature; and a spool rotational orientation feature configured to engage the wellhead structure to rotationally orient the tubing hanger orientation spool with respect to the wellhead structure:

a running tool connectable to the tubing hanger and comprising a camming member configured to selectively engage with the camming surface;

wherein the tubing hanger is rotatable to a predetermined orientation by movement of the camming member against the camming surface; and wherein the camming member is guidable by the guiding feature to maintain the tubing hanger in the predetermined orientation as the tubing hanger is landed.

2. The assembly of claim 1, wherein:

the camming surface comprises a down-facing camming surface;

the guiding feature comprises an orientation slot;

the camming member comprises a pin;

the tubing hanger is rotatable to the predetermined orientation by upward movement of the pin against the camming surface; and the tubing hanger is landable in the predetermined orientation by downward movement of the running tool with the pin in the orientation slot.

3. The assembly of claim 1, wherein the tubing hanger is landable on a seat included within a bore of the wellhead structure.

4. The assembly of claim 3, wherein:

the tubing hanger is landable on a seat included within a bore of the wellhead structure;

the tubing hanger comprises a landing ring with shear pins to hold the landing ring in position with respect to the tubing hanger; and the tubing hanger is landable with respect to the wellhead structure in a soft landed position wherein the landing ring is coupled to the tubing hanger with the shear pins intact; and the tubing hanger is landable in the predetermined orientation with respect to the wellhead structure in a hard landed position with the shear pins sheared and the landing ring movable with respect to the tubing hanger.

5. The assembly of claim 1, wherein the tubing hanger is landable in the predetermined orientation with respect to the wellhead structure comprising a soft landed position and a hard landed position such that, in the soft landed position, the camming member is positioned to engage the camming surface, and in the hard landed position, the camming member is positioned in the guiding feature.

6. The assembly of claim 1, wherein the guiding feature comprises an orientation slot with a wider portion towards an upper end thereof and a narrower portion towards a lower end thereof.

7. The assembly of claim 1, wherein:

the camming surface is formed in a bore of the tubing hanger orientation spool; and the camming surface comprises a helical groove.

8. The assembly of claim 1, wherein the camming surface comprises a sleeve positionable within a recess in a bore of the tubing hanger orientation spool.

9. The assembly of claim 1, wherein the camming member comprises a hydraulically actuated pin, and wherein the camming member is biased towards an un-extended position with respect to the running tool.

10. The assembly of claim 1, further comprising a blowout preventer connected to the tubing hanger orientation spool.

11. The assembly of claim 1, further comprising a connector to connect the wellhead structure and the tubing hanger orientation spool.

12. A method of installing a tubing hanger in a subsea well including a wellhead structure, comprising:

engaging a spool rotational orientation feature of a spool with a wellhead structure to rotationally orient the spool with respect to the wellhead structure, the spool separate from and connectable to the wellhead structure;

lowering a running tool with the tubing hanger connected thereto into the spool;

engaging a running tool orientation feature of the running tool with a spool orientation feature of the spool;

moving the running tool with respect to the spool such that the engagement of the running tool orientation feature with the spool orientation feature rotates the tubing hanger to a predetermined orientation with respect to the spool; and moving the running tool with respect to the spool such that the engagement of the running tool orientation feature with the spool orientation feature lands the tubing hanger in the predetermined orientation with respect to the spool.

13. The method of claim 12, wherein:

the first moving the running tool comprises raising the running tool with respect to the spool such that the tubing hanger rotates to the predetermined orientation with respect to the spool; and the second moving the running tool comprises lowering the running tool with respect to the spool such that the tubing hanger lands in the predetermined orientation with respect to the spool.

14. The method of claim 13, wherein:

the engaging the running tool orientation feature comprises extending a pin from the running tool into a bore of a tubing hanger orientation spool;

the raising the running tool comprises raising the running tool in the bore of the tubing hanger orientation spool such that the pin engages the camming surface to orient the running tool and the tubing hanger connected thereto with respect to the bore of the tubing hanger orientation spool and the pin engages an orientation slot; and the second lowering the running tool comprises lowering the running tool in the bore of the tubing hanger orientation spool such that the tubing hanger lands within a seat positioned within the bore of the wellhead structure connected to the tubing hanger orientation spool.

15. The method of claim 14, further comprising torqueing the running tool away from the camming surface when the pin is engaged with the orientation slot.

16. The method of claim 13, wherein the tubing hanger comprises a landing ring with shear pins to couple the landing ring to the tubing hanger.

17. The method of claim 16, wherein:

the first lowering the running tool comprises landing the tubing hanger in a soft landed positioned with respect to a seat of the wellhead structure such that the landing ring is coupled to the tubing hanger with the shear pins intact; and the second lowering the running tool comprises landing the tubing hanger in a hard landed positioned with respect to the seat such that the shear pins are sheared with the landing ring movable with respect to the tubing hanger.

18. The method of claim 12, further comprising:

connecting the spool to the wellhead structure.

19. A subsea well installation assembly for installing a tubing hanger in a subsea well including a wellhead structure, comprising:

a spool separate from and connectable to the wellhead structure, the spool comprising:

a spool orientation feature; and a spool rotational orientation feature configured to engage the wellhead structure to rotationally orient the spool with respect to the wellhead structure;

a running tool connectable to the tubing hanger and comprising a running tool orientation feature;

wherein the tubing hanger is rotatable to the predetermined orientation by movement of the running tool with respect to the spool such that the running tool orientation feature engages the spool orientation feature; and wherein the running tool orientation feature is guidable by the spool orientation feature to maintain the tubing hanger in the predetermined orientation as the tubing hanger is landed.

20. The assembly of claim 19, wherein:

one of the spool orientation feature and the running tool orientation feature comprises a camming surface and a guiding feature;

the other of the spool orientation feature and the running tool orientation feature comprises a camming member configured to selectively engage the camming surface;

the tubing hanger is rotatable to the predetermined orientation by movement of the camming member against the camming surface; and the tubing hanger is landable in the predetermined orientation by movement of the running tool with the camming member engaging the guiding feature.

* * * * *